US007677678B2

(12) United States Patent
Mosel et al.

(10) Patent No.: US 7,677,678 B2
(45) Date of Patent: Mar. 16, 2010

(54) WHEELCHAIR ACCOMMODATING SYSTEM

(75) Inventors: James A. Mosel, Eau Claire, WI (US); Jonathan F. Riggs, Eau Claire, WI (US)

(73) Assignee: Spectrum Industries Inc., Chippewa Falls, WI (US)

( * ) Notice: Subject to any disclaimer, the term of this patent is extended or adjusted under 35 U.S.C. 154(b) by 418 days.

(21) Appl. No.: 10/864,902

(22) Filed: Jun. 9, 2004

(65) Prior Publication Data

US 2005/0275322 A1 Dec. 15, 2005

(51) Int. Cl.
*A47F 5/12* (2006.01)

(52) U.S. Cl. ..... 312/231; 108/7

(58) Field of Classification Search ..... 108/5–10, 108/20, 96, 189, 138, 147; 312/312, 231, 312/233; 248/419
See application file for complete search history.

(56) References Cited

U.S. PATENT DOCUMENTS 806,304 A 12/1905 Street
1,256,218 A 2/1918 Foster
1,836,466 A 12/1931 Hamilton
D145,651 S * 10/1946 Bennett ..... D6/477
3,443,031 A 5/1969 Bolick
3,586,409 A * 6/1971 Cisler ..... 312/111
3,638,584 A * 2/1972 Cisler et al. ..... 108/6
3,687,088 A * 8/1972 Hasbrouck et al. ..... 108/2
3,848,944 A 11/1974 Gilmer
4,194,452 A * 3/1980 Crowther et al. ..... 108/138
4,440,096 A * 4/1984 Rice et al. ..... 108/3
4,469,029 A * 9/1984 Ramond ..... 108/3
4,566,741 A * 1/1986 Eriksson et al. ..... 312/194
4,576,424 A * 3/1986 Nelson ..... 312/231
4,637,322 A * 1/1987 Hampshire et al. ..... 108/102
4,681,042 A * 7/1987 Roberts ..... 108/6
4,714,224 A 12/1987 Calmes
4,726,556 A 2/1988 Weir
4,827,439 A * 5/1989 Licht ..... 361/681
5,041,770 A * 8/1991 Seiler et al. ..... 318/265
5,231,562 A * 7/1993 Pierce et al. ..... 361/832
5,242,145 A 9/1993 Linnell
5,273,247 A 12/1993 Jan
5,410,971 A * 5/1995 Golden et al. ..... 108/6
5,450,800 A 9/1995 Leonard
5,660,117 A 8/1997 Noble
5,660,450 A 8/1997 Huang
5,669,314 A * 9/1997 Grant ..... 108/48
5,690,310 A 11/1997 Brown
5,826,882 A * 10/1998 Ward ..... 273/309
5,868,079 A * 2/1999 Charny ..... 108/7
5,884,882 A 3/1999 Nada et al.

(Continued)

FOREIGN PATENT DOCUMENTS

JP 2002-17451 * 1/2002

(Continued)

*Primary Examiner*—Janet M Wilkens
(74) *Attorney, Agent, or Firm*—Foley & Lardner LLP

(57) ABSTRACT

A wheelchair accommodating system and method for providing an ergonomically suitable environment for users having a motor skill limitation and users without a motor skill limitation is provided. The system includes a height adjustment system, a depth adjustment system, and a tilt adjustment system that can be selectively actuated by a user to adjust the position of a platform of the system.

39 Claims, 7 Drawing Sheets

U.S. PATENT DOCUMENTS

| | | | | |
|---|---|---|---|---|
| 5,927,213 | A * | 7/1999 | Leday | 108/96 |
| 5,961,134 | A | 10/1999 | Congleton et al. | |
| 6,024,427 | A | 2/2000 | Underwood et al. | |
| 6,145,800 | A | 11/2000 | Watkins | |
| 6,471,019 | B1 | 10/2002 | Miller | |
| 6,760,649 | B2 * | 7/2004 | Cohen | 700/299 |
| 6,832,688 | B1 * | 12/2004 | Rivera et al. | 206/581 |
| 7,049,728 | B2 * | 5/2006 | Bastholm | 310/317 |
| 7,106,014 | B1 * | 9/2006 | Mastalir et al. | 318/280 |
| 2003/0154890 | A1 * | 8/2003 | Warner | 108/145 |

FOREIGN PATENT DOCUMENTS

| | | | |
|---|---|---|---|
| JP | 2002-177220 | * | 6/2002 |
| JP | 2002-177221 | * | 6/2002 |

* cited by examiner

WHEELCHAIR ACCOMMODATING SYSTEM

FIELD

The present invention relates generally to systems designed to accommodate a user having a disability such as a motor skill limitation. More particularly, the present invention relates to workstations and work surfaces designed to accommodate a user having a motor skill limitation such as a person confined to a wheelchair, and in one embodiment, relates to workstations and work surfaces that are selectively adjustable by a user to accommodate both a wheelchair user and a non-wheelchair user.

BACKGROUND

Persons having a motor skill limitation, such as a person confined to a wheelchair, are often unable to make use of systems designed for persons without a motor skill limitation. For example, a conventional desk, table, or other work surface is typically designed for a person who does not have a motor skill limitation. Often, a wheelchair user is unable to use such a system for reasons including, but not limited to, the height of the work surface is not in a position suitable for the wheelchair user, the configuration of the system prevents the user's wheelchair from moving near the work surface, articles positioned on the work surface are beyond the reach of the wheelchair user, etc.

Governments have enacted legislation demonstrating a general desire to provide persons with a disability, including those having a motor skill limitation, access to systems used by non-disabled persons whenever practically possible. Recently, there have been amendments made to such legislation that focus on technology and an overall goal of making electronics and information technology to accessible to disabled persons.

It is generally known to provide a supplemental work surface or workstation that is designed specifically to accommodate a disabled person such as a person confined to a wheelchair. Often such systems require the user to be moved to the work surface and/or provide limited adjustably for the user. Such systems are often must be purchased in addition to systems designed for non-disabled persons. The cost of purchasing multiple systems may be excessive and may discourage parties from adding a system designed specifically for a person having a mobility related disability.

Accordingly, it would be desirable to provide a system, such as a system having a work surface, that is designed to accommodate a user having a motor skill limitation. It would further be advantageous to provide a system incorporating electronics and/or information technology that is designed to accommodate a user having a motor skill limitation. It would also be desirable to provide a system having a work surface that can be brought to the user. It would also be advantageous to provide a system that may be equally suitable for use by a person having a motor skill limitation and by a person without a motor skill limitation. It would further be advantageous to provide a system having a work surface that may be selectively adjusted by a user to position the work surface in an orientation that is ergonomically suitable for the user. It would further be desirable to provide a system of the type disclosed in the present application that includes any one or more of these or other advantageous features.

SUMMARY

An embodiment relates to a wheelchair accommodating system for providing an ergonomically suitable environment for users having a motor skill limitation and users without a motor skill limitation. The system includes a support structure and a first platform coupled to the support structure. The first platform has an initial height, angle of rotation, and depth. The system further includes a height adjustment mechanism coupled to the support structure for adjusting the height of the first platform, a tilt adjustment mechanism coupled to the support structure for adjusting the an angle of rotation of the first platform, and a depth adjustment mechanism coupled to the support structure for adjusting the depth of the first platform. A user may selectively actuate the height adjustment mechanism, the tilt adjustment mechanism, and the depth adjustment mechanism to bring the first platform to the user to provide a work surface that is ergonomically suitable for the user.

Another embodiment relates to a lectern system that is suitable for use by a wheelchair user and a non-wheelchair user. The lectern system includes a support structure and a work surface coupled to the support structure and having a first height, angle of rotation, and depth. The lectern system further includes a height adjustment mechanism coupled to the support structure for adjusting the height of the work surface, a tilt adjustment mechanism coupled to the support structure for adjusting the an angle of rotation of the work surface, and a depth adjustment mechanism coupled to the support structure for adjusting the depth of the work surface. A user may selectively actuate the height adjustment mechanism, the tilt adjustment mechanism, and the depth adjustment mechanism to bring the work surface to the user to provide a work surface that is ergonomically suitable for the user.

Still another embodiment relates to a workstation providing a ergonomically suitable work surface for all users. The workstation includes a support structure and a first platform. The first platform has an initial height, depth, and tilt. The workstation further includes a means for adjusting the height of the first platform, a means for adjusting the depth of the first platform, and a means for adjusting the tilt of the first platform. A user may selectively adjust the height, depth, and tilt of the first platform to provide a work surface that is ergonomically suitable for the user.

A further embodiment relates to a method of providing a work surface that is ergonomically suitable for a wheelchair user and a non-wheelchair user. The method includes the steps of providing a support structure, and coupling a first platform to the support. The first platform is adjustable in a vertical direction, a horizontal direction, and a rotational direction. The method further includes the steps of enabling a wheelchair user to selectively adjust the first platform in the vertical, horizontal, and rotational direction to bring the first platform to the wheelchair user, and enabling a non-wheelchair user to selectively adjust the first platform in a vertical, horizontal, and rotational direction to bring the first platform to the non-wheelchair user.

DETAILED DESCRIPTION OF THE PREFERRED AND OTHER EXEMPLARY EMBODIMENTS

Figure 1:
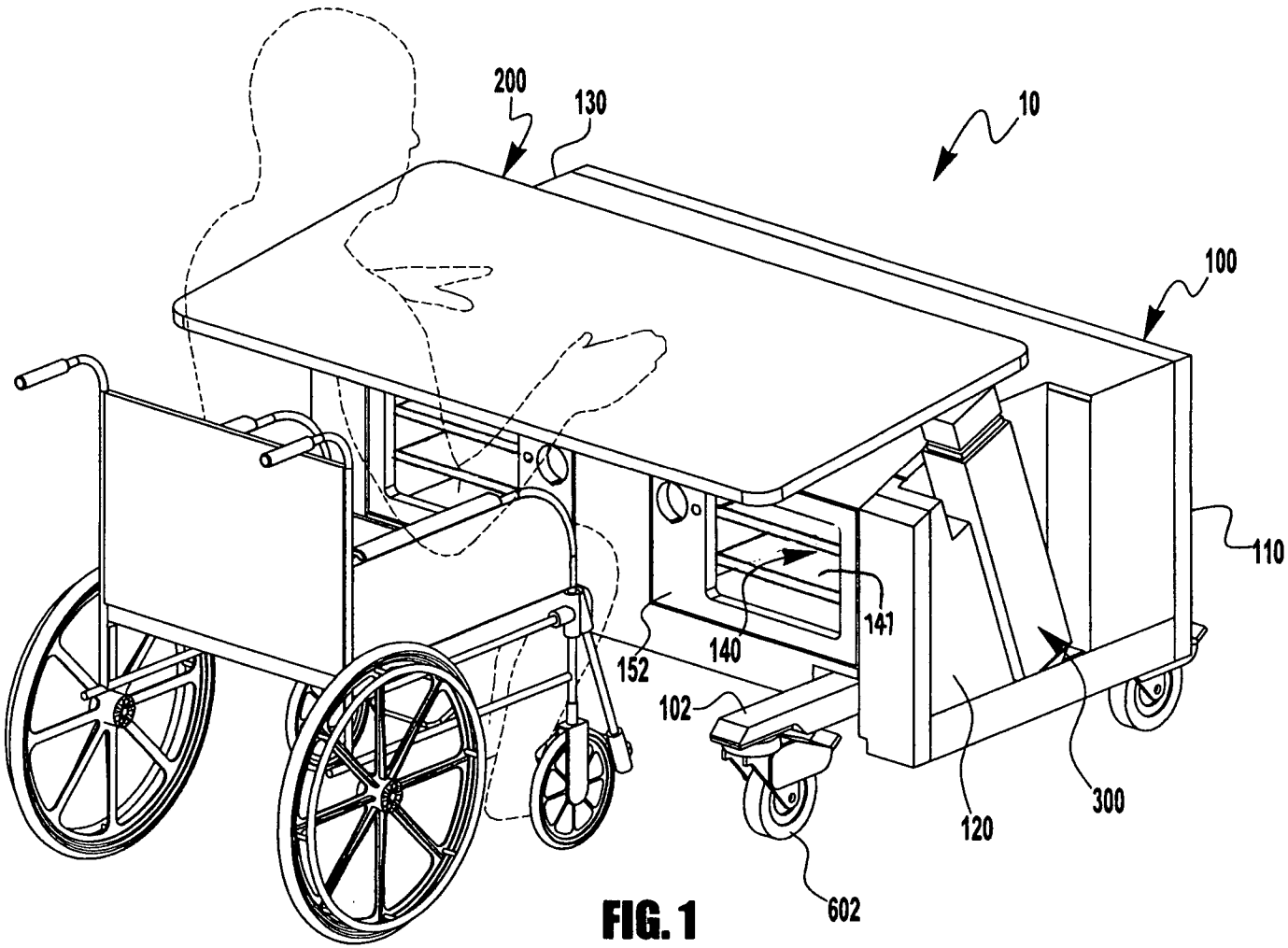
FIG. 1 is a perspective view of a wheelchair accommodating system according to an exemplary embodiment.

With reference to the FIGURES, a wheelchair accommodating system 10 is provided and generally includes a base or support structure 100, a member or first platform 200, a height adjustment system 300, a depth adjustment system 400, and a tilt adjustment system 500. System 10 may further include components to enable the system to be relatively movable (e.g., mobile, portable, etc.). Still further, system 10 may include a control system enabling a user to actuate the selective reconfiguration or positioning of system 10.

The embodiments of system 10 can advantageously provide an environment that may be effectively used by both a wheelchair user and a non-wheelchair user in a position that may be ergonomically suitable for both types of users.

As used herein, the term "wheelchair user" is used generally to describe those users having a motor skill limitation. The term may refer to a user who makes use of a wheelchair, and is further intended to include users having motor skill limitations that do not make use of a wheelchair. Users having motor skill limitations may include users having limited reach, users having limitations relating to height, etc. Accordingly, system 10 may be configured to accommodate any such user.

Support structure 100, first platform 200, height adjustment system 300, depth adjustment system 400, and tilt adjustment system 500 cooperate to provide an environment wherein the features of system 10 may be positioned in an arrangement that is suitable for use by a wheelchair user and a non-wheelchair user alike. As explained below, system 10 includes means for selectively adjusting first platform 200 to bring the platform to the user rather than making the user move to the platform. In certain embodiments, adjustments may be accomplished by the physical manipulation of an actuation device, while in other embodiments, adjustments may be initiated by a control system including a sensory device.

System 10 can be configured to be used in a variety of applications where it would be beneficial to provide an environment that is ergonomically suitable for both a wheelchair user and a non-wheelchair user. Ergonomically suitable is used herein to describe a position wherein a user may access a feature (i.e., articles, work surface, etc.) of system 10 and particularly first platform 200 with relative ease and in a manner that is not likely to cause the user undue discomfort resulting from the positioning of the system. System 10 is particularly suited for applications such as workstations and work surfaces. The FIGURES illustrate one particular embodiment of system 10, namely one wherein system 10 is employed as a system suitable for use during a presentation or lecture (e.g., a lectern, desk, table, podium, and the like). It should be understood at the outset that the advantageous features of system 10 are not limited to use as a lectern, and may be equally suitable with other applications.

Referring to FIG. 1, system 10 illustrated is a lectern of the type commonly used in a presentation environment (e.g., classrooms, training facilities, conference rooms, auditoriums, and the like). A user may make use of the lectern when addressing an audience by using the lectern to hold writing utensils, pointers, papers, books, and/or other reference materials. The lectern may further be used by a user as a conventional desk, table, workstation, etc.

According to a preferred embodiment, system 10 is a multi-media lectern configured to support articles such as display monitors, processing units, peripheral equipment, sensor systems, control equipment, storage receptacles, etc. As a multi-media lectern, system 10 may also include a surface that can be used by a user to hold notes, reference or presentations materials, etc. Multi-media lecterns have become increasingly popular in the classroom and corporate settings, as well as in auditoriums, lecture halls, convocation centers, and the like. Multi-media lecterns may provide a centralized location for a variety of articles commonly used during a presentation.

Referring to FIG. 1, first platform 200 is shown as a top portion of system 10. First platform 200 is illustrated as being a substantially flat surface having a generally rectangular shape. In alternative embodiments, first platform 200 may have a surface that includes concave or convex portions, and may further be configured in any of a variety of shapes (e.g., circular, polygonal, curvilinear, etc., and any combination thereof). In addition, first platform 200 may include additional or auxiliary platforms, tiers, surfaces, and the like depending upon the application. According to an preferred embodiment, first platform 200 may be used as a work surface and/or as a surface capable of supporting an article.

According to a particularly preferred embodiment, first platform 200 is configured to support articles commonly used with multi-media lecterns. For example, first platform 200 may support a display monitor, peripheral equipment, a microphone, and/or a lighting system. The use of the term support, as used herein, is intended to include articles that are integrally coupled with first platform 200 and those articles which are otherwise attached and/or placed upon first platform 200. First platform 200 may further include a control panel having a user interface to allow a user to operate any of a variety of systems (e.g., lighting, audio, video, HVAC, backdrops or screens, etc.). According to an exemplary embodiment, the control panel may be a touch screen control panel. As most clearly illustrated in FIG. 1, first platform 200 may include a area for a user to place notes or other reference materials that may be used during a presentation (e.g., a work surface).

According to an exemplary embodiment, first platform 200 may include a lip (not shown) near a bottom portion of the first platform. The lip may be used to retain an article (e.g., papers, books, notes, writing utensils, pointers, etc.) on first platform 200, particularly if first platform 200 is positioned at an angle other than horizontal as will be described below. According to various exemplary embodiments, first platform 200 may include any of a variety of techniques to retain an article on the platform such as, but not limited to, magnetic portions, recesses, brackets, adhesives, etc.

Figure 10:
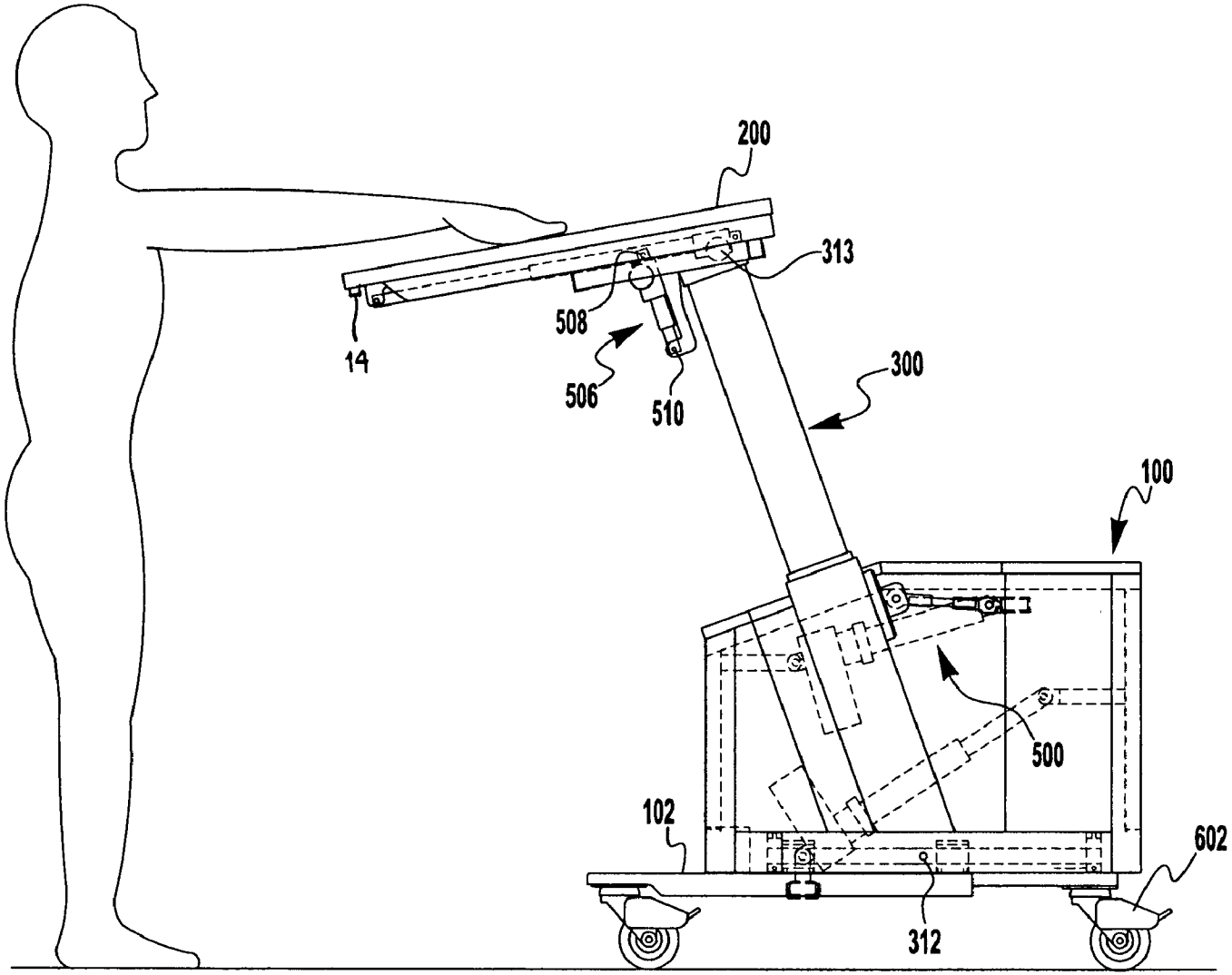
FIG. 10 is a side view of a wheelchair accommodating system according to an exemplary embodiment illustrating a non-wheelchair user using the system.

A typical user of system 10, as illustrated in the FIG. 10, is likely to be a non-wheelchair user (e.g., a standing user who does not have a motor skill limitation). In a presentation environment, system 10 may be positioned in front of an audience (e.g., in a classroom, training facility, lecture hall, conference room, etc.). During a presentation, system 10 is likely to be situated between the user and the audience. System 10 is configured to provide first platform 200 in a position that is ergonomically suitable for the non-wheelchair user.

Figure 9:
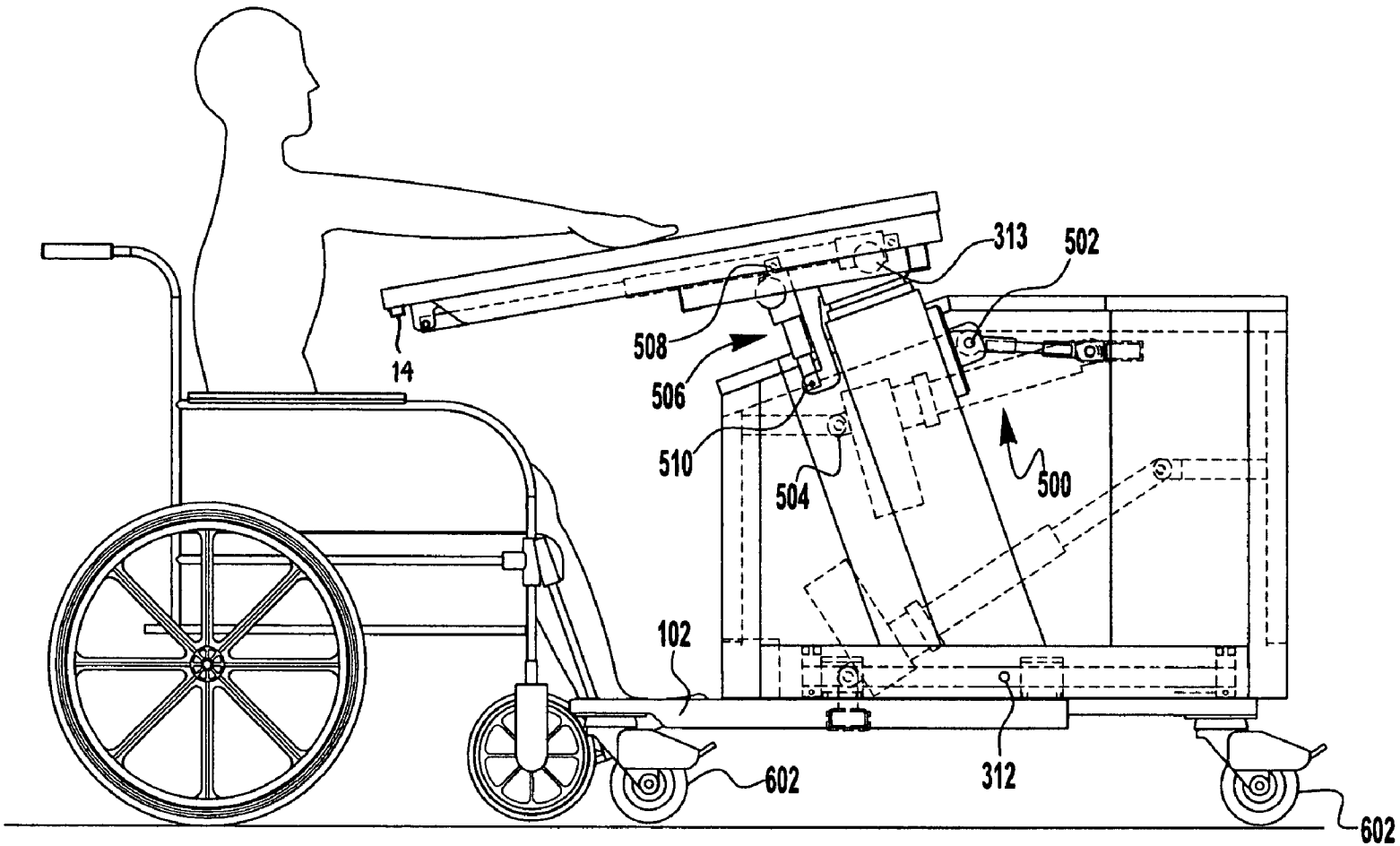
FIG. 9 is a side view of a wheelchair accommodating system according to an exemplary embodiment illustrating a wheelchair user using the system.

While the typical user of system 10 may be a non-wheelchair user, system 10 is also intended to be used by a wheelchair user (see FIGS. 1 and 9). During a presentation, a wheelchair user, similar to a non-wheelchair user, is likely to be positioned behind system 10. System 10 is configured to provide first platform 10 in a position that is ergonomically suitable for the wheelchair user. In addition to providing a wheelchair user access to the features of first platform 200 in a manner not likely to cause undue discomfort, system 10 is preferably configured so that first platform 200 will not obstruct the line of sight between a wheelchair user and the audience. As can be appreciated, in certain applications it may be desirable to allow a wheelchair user to have eye contact with the audience, preferably the entire audience including those people seated in the first and second rows.

To provide system 10 with a first platform 200 that is ergonomically suitable for both a non-wheelchair and a wheelchair user, first platform 200 is designed to move in a vertical, horizontal, and rotational direction until a position that is suitable to the user is attained. System 10 preferably provides for a relatively wide range of movement of first platform 200 to accommodate a variety of users. As can be appreciated, the desired position of first platform 200 for a non-wheelchair user may vary significantly from the desired position for a wheelchair user. In addition, the desired position between different non-wheelchair users is likely to vary as is the desired position between different wheelchair users. System 10 may be designed to accommodate any such user.

According to an exemplary embodiment, system 10 is designed to accommodate non-wheelchair users ranging in height from approximately 4 feet to approximately 7 feet. According to an exemplary embodiment, system 10 is further designed to accommodate wheelchair users wherein the seat portion of the wheelchair is greater than approximately 15 inches from the ground (e.g., floor, platform, base, etc.). Generally, for a wheelchair user having a height of 5 feet, the distance from the floor to the wheelchair seat may be approximately 18 inches and the distance from the floor to the top of the armrest may be approximately 25 inches. In comparison, for a wheelchair user having a height of 6 feet, 6 inches, the distance from the floor to wheelchair seat may be approximately 20 inches and the distance from the floor to the top of the armrest may be approximately 30 inches.

Figure 4:
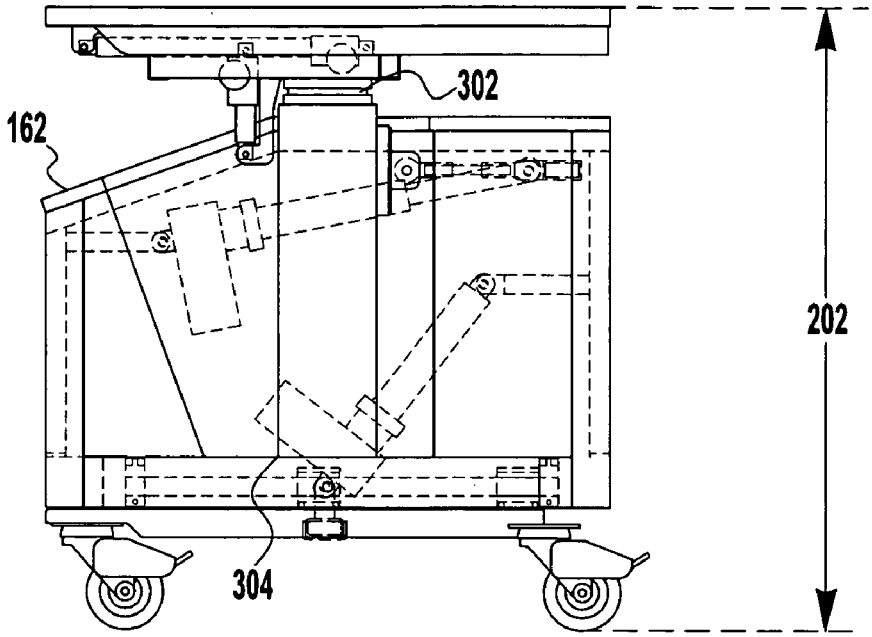
FIG. 4 is a side view of a wheelchair accommodating system according to an exemplary embodiment illustrating a first platform in a lowered position.
Figure 5:
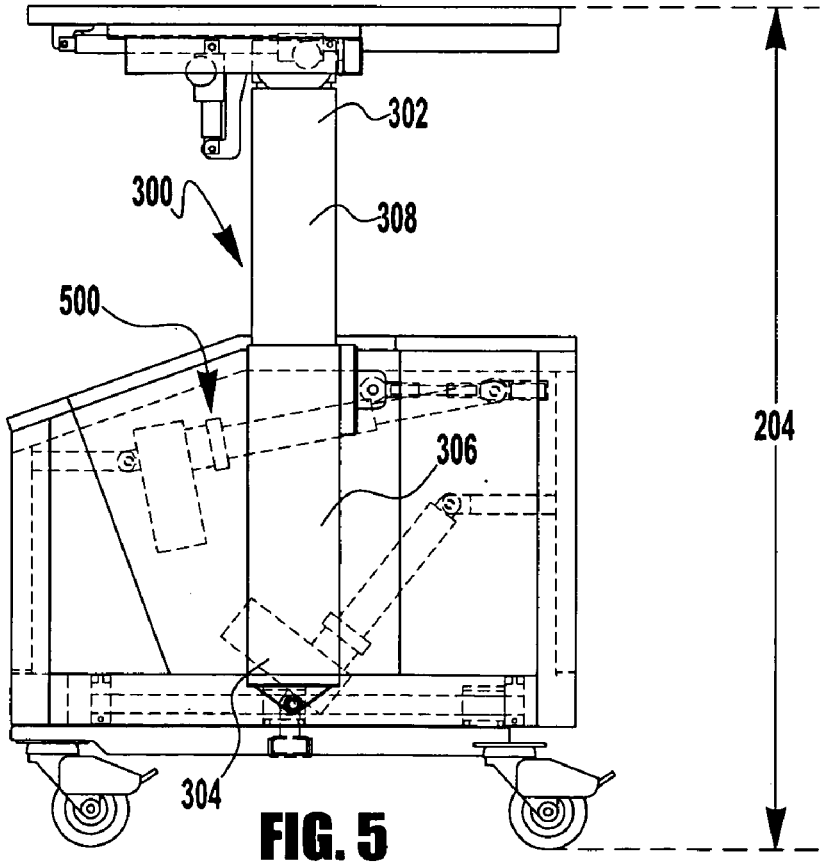
FIG. 5 is a side view of a wheelchair accommodating system according to an exemplary embodiment illustrating a first platform in an elevated position.

Referring to FIGS. 4 and 5, the height adjustment capabilities of first platform 200 are illustrated. First platform 200 moves in a generally vertical direction between a first position (e.g., retracted position, lowered position, etc.) (shown in FIG. 4) wherein a surface of first platform 200 is at a height 202 from the floor and a second position (evaluated position, raised position, etc.) (shown in FIG. 5) wherein a surface of first platform is at a height 204 from the floor. Preferably, first platform 200 can be positioned at any height between height 202 and height 204. According to an exemplary embodiment, height 202 is approximately 30 inches and height 204 is approximately 50 inches. According to various alternative embodiments, the range between height 202 and height 204 may be varied depending on the particular application.

Figure 6:
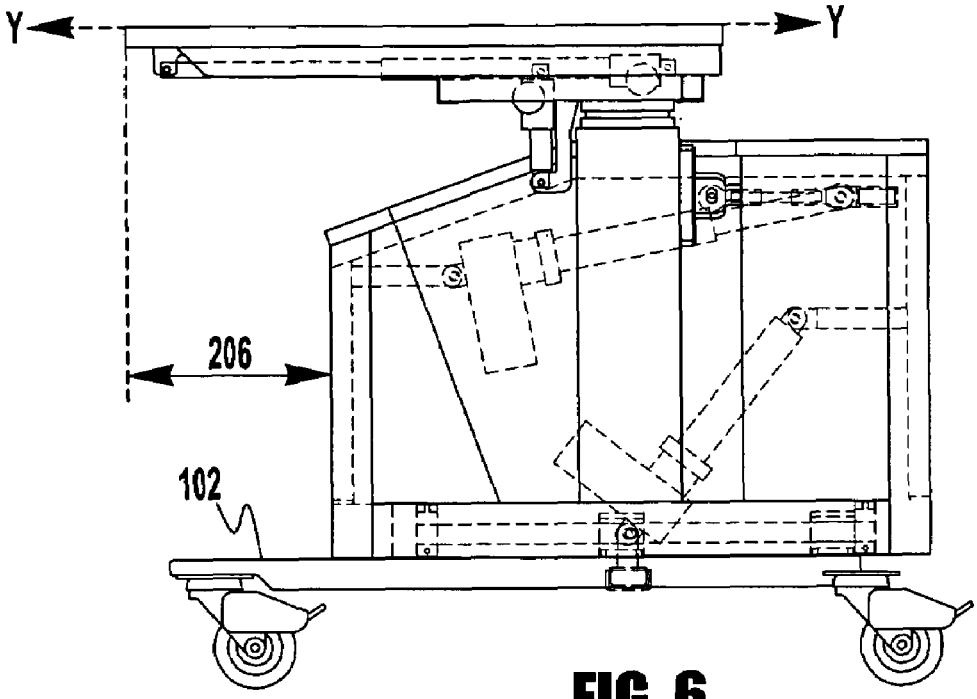
FIG. 6 is a side view of a wheelchair accommodating system according to an exemplary embodiment illustrating a first platform in an extended position.

Referring to FIGS. 4 and 6, the depth adjustment capabilities of first platform 200 are illustrated. First platform 200 moves in a generally longitudinal direction between a first position (shown in FIG. 4) wherein the platform 200 is approximately centered with the support structure, and a second position (shown in FIG. 6) wherein an edge of first platform 200 is offset a distance 206 from a rear portion of the support structure. Preferably, first platform 200 can be positioned at any depth between the first position and distance 206. According to an exemplary embodiment, distance 206 is approximately 18 inches. As can be appreciated, distance 206 may vary depending on the application. According to a further alternative embodiment, first platform 200 may be configured to move from the position shown in FIG. 4 to a position that is offset in a longitudinal direction away from the user.

Referring to FIGS. 1, 9, and 10, the tilt adjustment capabilities of first platform 200 are illustrated. First platform 200 may be rotated about an axis extending in the same direction as axis x-x, between a first position (shown in FIG. 4) wherein the angle of rotation is approximately 0 degrees from an axis y-y, to a second position (shown in FIG. 7) wherein first platform 200 is rotated an angle 208 from axis y-y. Preferably, first platform 200 can be rotated to any angle between the first position and angle 208. According to an exemplary embodiment, angle 208 is approximately 20 degrees. As can be appreciated, angle 208 may vary depending on the application.

Referring to FIG. 1, support structure 100 is configured to support first platform 200 and may further be configured support and/or define additional features of system 10. Support structure 100 may be configured as a frame-like structure having any number of links or members, arranged in a variety of configurations, for supporting first platform 200. According to an exemplary embodiment, support structure 100 includes a front panel 110 and a pair of spaced apart side panels 120, 130. According to a preferred embodiment, side panels 120, 130 are aligned substantially perpendicular with front panel 110 forming a U-shaped cavity 140. Support structure 100 may further include a rear panel 150, a top panel 160, and bottom panel 170. The additional panels may provide additional support or may simply further define cavity 140. In exemplary embodiments, the panels may be directly coupled to one another, directly coupled to a frame structure, and/or coupled to both a frame structure and to one another.

Figure 7:
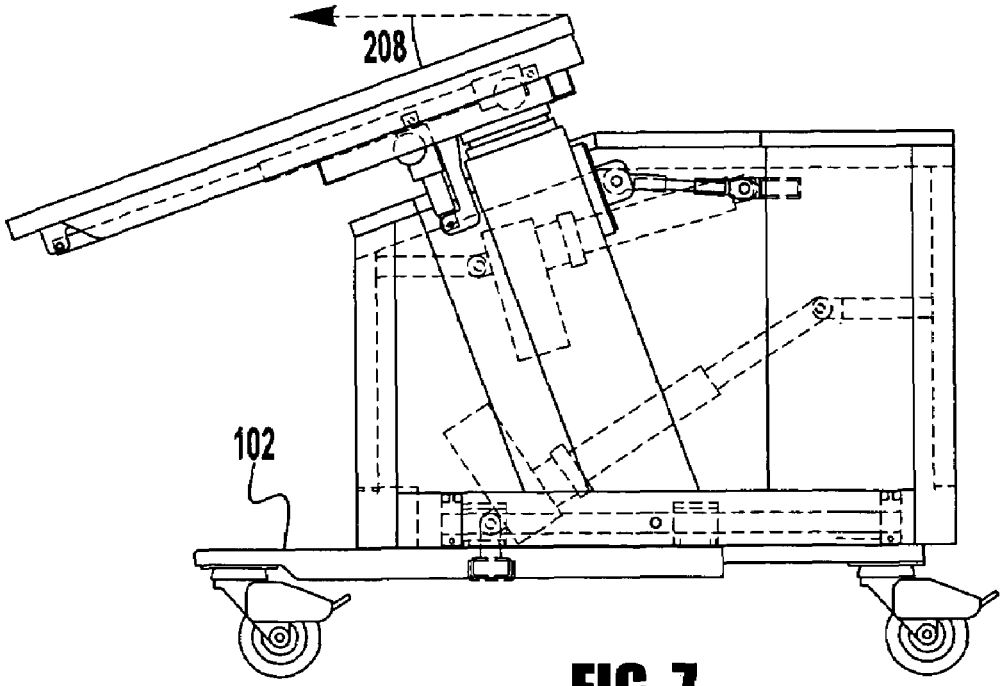
FIG. 7 is a side view of a wheelchair accommodating system according to an exemplary embodiment illustrating a first platform in a lowered and tilted position.

As described above, first platform 200 moves between a variety of positions to meet the needs of a user. Accordingly, support structure 100 is configured to allow first platform 200 to move between a range of positions without interfering or hindering such movement. According to an exemplary embodiment, support structure 100 has a profile designed to increase the range at which first platform 200 may be moved. According to a preferred embodiment, as shown in FIG. 7, support structure 100 defines an inclined plane to allow first platform 200 to rotate towards a user in a lowered position without striking or contacting support structure 100. According to a particularly preferred embodiment, a panel 162 is positioned across the inclined plane and further defines cavity 140. In alternative embodiments, the perimeter of support structure 100 may be shaped in a variety of ways to achieve the desired range of travel for first platform 200 such as by included inclined portions and/or curvilinear portions.

Figure 2:
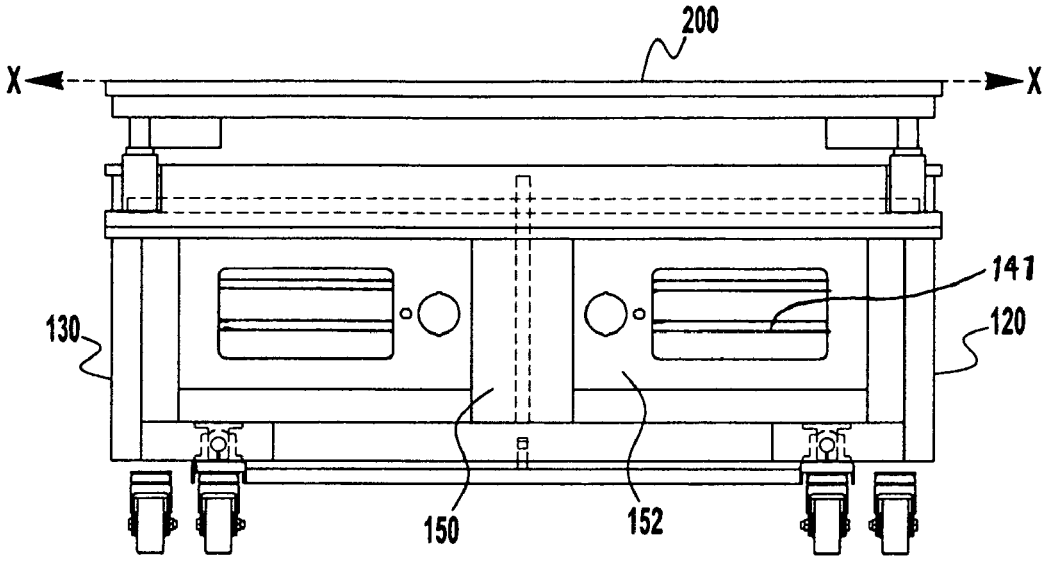
FIG. 2 is a back view of a wheelchair accommodating system according to an exemplary embodiment.

In addition to supporting first platform 200, support structure may advantageously provide a storage area for system 10. Referring to FIG. 2, and according to an exemplary embodiment, rear panel 150 includes a opening for allowing a user to access cavity 140. A door 152 or other movable member may be movably coupled to support structure 100 and disposed in front of the opening. In a preferred embodiment, a series of platforms are aligned in cavity 140 to support articles including, but not limited to, audio equipment, video equipment, processing units, peripheral equipment, etc. According to a to a particularly preferred embodiment, cavity 140 is configured to receive a plurality of rack rails 141 (i.e., drawers or shelves specifically dimensioned to receive multimedial equipment) as shown in FIGS. 1 and 2. Support structure 100 may further include a ventilation system to protect the articles stowed within cavity 140 from becoming damaged due to overheating.

Support structure 100 is further configured to support the adjustment systems 300, 400, and 500 providing for the selective adjustment of first platform 200. According to an exemplary embodiment, the systems include multiple mechanisms that are incorporated with system 10 to provide for the movement of first platform 200. In alternative embodiments, movement of first platform 200 may be provided by a single mechanism capable of controlling the height, depth, and tilt of first platform 200. In further alternative embodiments, movement of first platform 200 may be provided by a mechanism capable of controlling at the movement in at least two directions, and an additional mechanism may be used for the other direction.

According to an exemplary embodiment, height adjustment system 300 elevates and lowers first platform 100 in substantially a vertical direction depending upon the needs of a user. Referring to FIGS. 4 and 5, height adjustment system 300 includes a mechanism having a first end 302 that is coupled to first platform 200 and a second end 304 that is coupled to support structure 100. Height adjustment system 300 is configured to move first platform between height 202, a retracted position (i.e., lowered position), and height 204, an extended position (i.e., raised position).

According to a preferred embodiment, height adjustment system 300 is a telescopic drive system having a first column member 306 and a second column member 308. Second column member 308 is telescopically received within first column member 306. As can be appreciated, any number of column members may be telescopically received between first column member 306 and second column member 308. According to a preferred embodiment, first column member 306 includes a lower end coupled to support structure 100 and second column member 308 includes an upper end coupled to first platform 200. Second column member 308 extends upward relative to first column member to raise first platform 200. According to an exemplary embodiment, movement of height adjustment system 300 is provided by lead screw, or threaded shaft, rotatably attached to height adjustment system 300. An internally threaded nut is axially disposed around the lead screw and movement of the nut causes height adjustment system 300 to extend in and out. Actuation of the lead screw causes the nut to move up and down the lead screw depending on the direction the lead screw is rotated. According to a preferred embodiment, an electric motor has an output shaft that is coupled to the lead screw to provide for the actuation of height adjustment system 300. In alternative embodiments, actuation may be provided by manual manipulation of height adjustment system 300 by a user.

Height adjustment system 300 may be positioned in a variety of positions throughout support structure 100. According to an exemplary embodiment, height adjustment system 300 may be a single telescopic drive system centrally positioned in a lateral direction (i.e., side-to-side) of support structure 100. According to a preferred embodiment, height adjustment system 300 includes two spaced apart telescopic drive systems, with a telescopic drive system positioned substantially near each side panel 120, 130.

According to an exemplary embodiment, the height adjustment mechanism is of a type commercially available as "Telesmart Telescopic Drive System" (Model No. TMA) from Magnetic. According to alternative embodiments, the height adjustment mechanism may be any of a variety of air, gas, liquid, or hydraulic devices, electric, mechanical, or electromechanical devices, cylinders, actuators, linear movers, etc. that provide linear movement.

Figure 3:
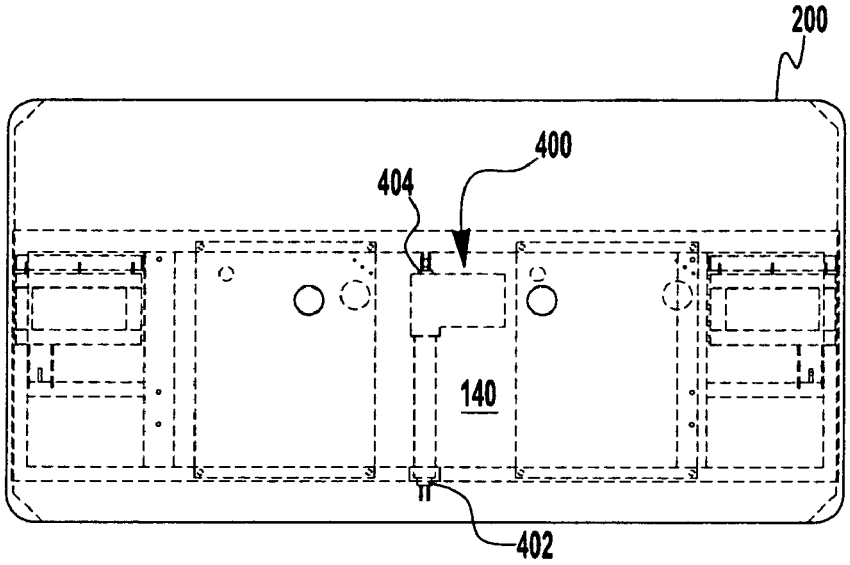
FIG. 3 is a top view of a wheelchair accommodating system according to an exemplary embodiment.

Referring to FIGS. 3 and 6, depth adjustment system 400 moves first platform 200 in longitudinally (i.e., fore and aft direction) along an axis y-y. Depth adjustment mechanism includes a first end 402 that is coupled to first platform 200 and a second end 404 that is coupled to support structure 100. According to an exemplary embodiment, a track or guide system is provided in a longitudinal direction on at least one of support structure 100 and first platform 200. A follower portion is coupled to the other of support structure and first platform 200 and slidably engages the guide system. The guide system and the follower cooperate to provide for the longitudinal movement of first platform 200. According to an exemplary embodiment, depth system 400 is a drive system designed to move first platform 200 along the guide system. According to a preferred embodiment, an electric drive system is used to adjust the depth of first platform 200.

Figure 8:
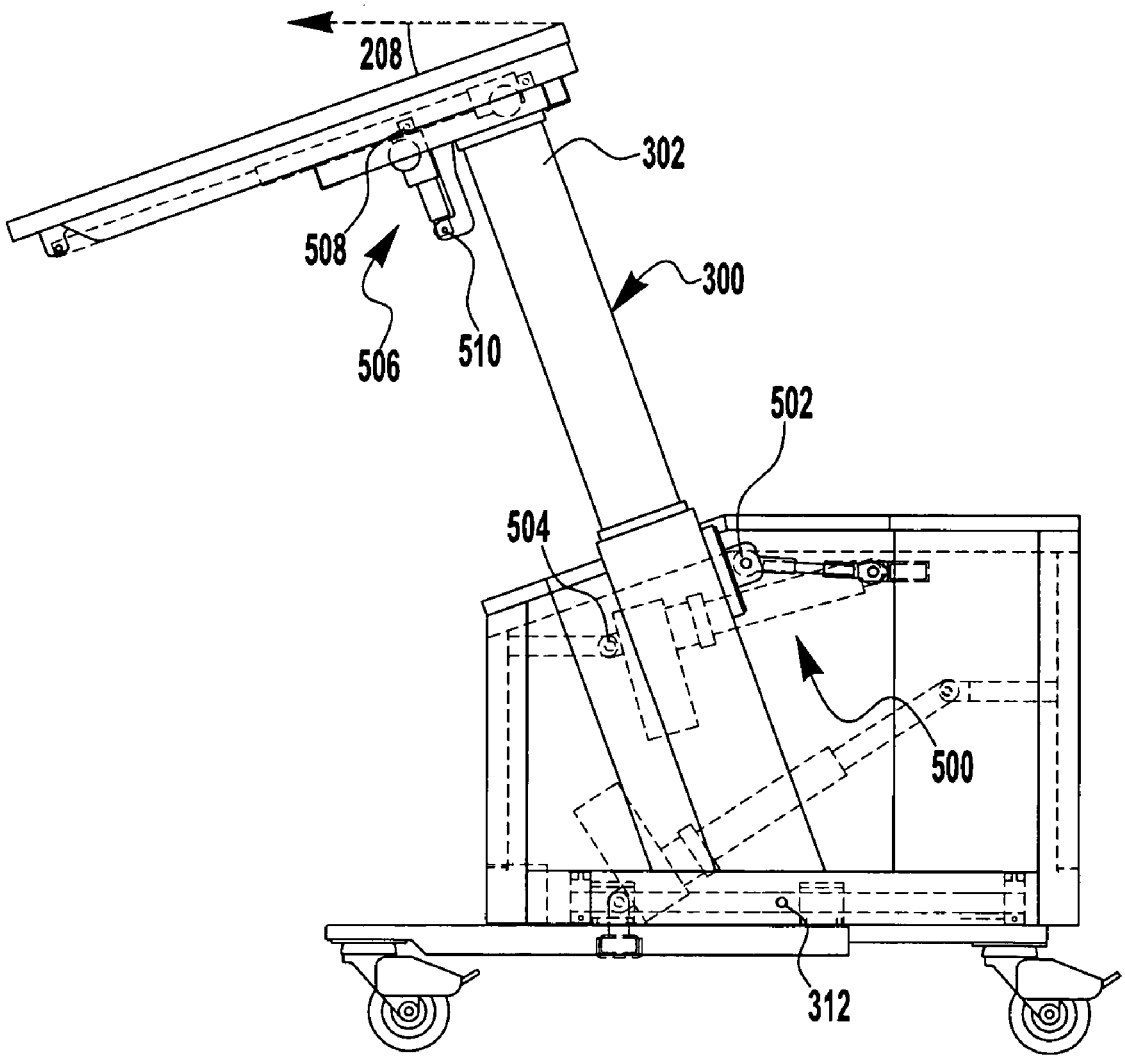
FIG. 8 is a side view of a wheelchair accommodating system according to an exemplary embodiment illustrating a first platform in a elevated and tilted position.

Referring to FIGS. 7 and 8, tilt adjustment system 500 adjusts that angle of rotation of first platform 200 about an axis extending in the x-x direction. Tilt adjustment system 500 includes a first end 502 that may be coupled to first platform 200 and a second end 504 that is coupled to support structure 200.

According to an exemplary embodiment, the angle of rotation of first platform 200 may be controlled by more than one tilt adjustment mechanism. According to a preferred embodiment, height adjustment system 300 is pivotally coupled to support structure 100 by a pivot shaft or rod 312. Height adjustment system 300 can be pivoted about pivot shaft 312 to adjust the angle of rotation of first platform 200. In such a configuration, movement of height adjustment system 300 about pivot shaft 312 may rotate first platform 200 up to angle 208. To rotate height adjustment system 300, a first tilt adjust mechanism is mounted to height adjustment system 300 at a first end 502 and to support structure 100 at a second end 504. Actuation of tilt adjustment mechanism rotates height adjustment system 300 about pivot shaft 312.

A second tilt adjustment mechanism 506 may then be used to provide a user with more control over the angle of rotation of first platform 200. According to a preferred embodiment, height adjustment system 300 is pivotally coupled to first platform 200 about a pivot shaft or rod 313. In such a configuration, second tilt adjustment mechanism 506 includes a first end 508 coupled to first platform 200 and a second end 510 coupled near a top portion of height adjustment system 300. Actuation of second tilt adjustment mechanism 506 rotates first platform 200 about pivot shaft 313 (shown in FIGS. 9 and 10).

System 10 may further include means enabling the system to be relatively mobile (e.g., movable, portable, etc.). Providing a relatively mobile system 10 may allow a user to selectively position system 10 throughout a room, and may allow a user to move system 10 between rooms, and/or between more distant locations. If system 10 is to be moved between rooms, system 10 is preferably sized to fit between conventionally sized door openings. According to an exemplary embodiment, a device is coupled to support structure 100 that is intended to reduce the friction between support structure 100 and the floor when movement is attempted. According to a preferred embodiment, rollers are coupled to support structure 100 to provide for the movement of system 10. According to a particularly preferred embodiment, casters 602 are positioned near the corners of support structure 100.

Referring to FIGS. 7 and 8, system 10 may further include a lower extension portion 102 that is intended to provide additional stability to system 10 when first platform 200 is in an extended position. Lower extension portion 102 may be configured to extend outward when a user extends first platform 200 towards the user. According to an exemplary embodiment, lower extension portion 102 may extend outward when first platform 200 is tilted towards a user. According to a preferred embodiment, a lower extension portion 102 is provided on each side of support structure 100 and the inclusion of such extensions members does not restrict a wheelchair user's access to the features of system 10.

System 10 further includes a control system (not shown) to control the positioning of first platform 200 and the positioning of lower extension portion 102. According to an exemplary embodiment, a control panel is coupled to system 10 to allow a user to actuate the control system. The control panel may include a user interface to allow a user to selectively control the position of first platform 200 and lower extension portion 102. Preferably, the control panel includes a user interface that enables a user to selectively adjust each movement of first platform 200 (height, depth, and tilt) independently. The user interface may be in the form of a receiver capable of receiving a signal from a transmitter operated by a user. In such a configuration, a user may have a controller that is operably coupled to system 10 (e.g., wireless, hardwired, etc.). In exemplary embodiments, the control system may include sensory devices capable of detecting the presence of a user without requiring a user to physically actuate a user interface. In alternative embodiments, the user interface may be in the form of conventional mechanical switches, buttons, gages, etc. According to an exemplary embodiment, the control panel is coupled to system 10 in a position that is accessible to a user. The control panel includes a user interface that when actuated adjusts the position of first platform 200.

System 10 may further include a safety system (not shown) to prevent first platform 200 and/or lower extension portion 102 from injuring a user. As can be appreciated, users having motor skill limitations may not be able to move out of the way of first platform 200 and lower extension portion 102 as the members are moving. The safety system may include sensors, brakes, catches, etc. to minimize the likelihood that a user will be harmed. Sensors for detecting the presence of an object such as a user's hand, arm, foot, etc. are generally known. Accordingly, in exemplary embodiments of system 10, the safety system may include any known or otherwise appropriate sensor for detecting an object.

According to a preferred embodiment, system 10 includes a pressure sensitive sensors positioned at potential pinch points. For example, as shown in FIGS. 9 and 10, a sensor 14 may be positioned along a bottom portion of first platform 200 near an edge close to the user. In alternative embodiments, the sensors may be positioned in a variety of locations throughout system 10. Preferably, upon detection of an object, the sensors send an output signal to a processing unit and the movement of first platform 200 is stopped.

Referring to FIGS. 5, 8, and 10, and according to various alternative embodiments, system 10 may further include a barrier, drape, curtain, or privacy panel designed to block a non-wheelchair user's body or torso when first platform is in an elevated position.

It is also important to note that the construction and arrangement of the elements of the wheelchair accommodating system as shown in the preferred and other exemplary embodiments is illustrative only. Although only a few embodiments of the present inventions have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. Further, elements shown as integrally formed may be constructed of multiple parts or elements shown as multiple parts may be integrally formed, the operation of the interfaces (e.g. tabs, fingers, apertures, etc.) may be reversed or otherwise varied, or the length or width of the structures and/or members or connectors or other elements of the system may be varied. Further, elements described as being coupled together may be either directly coupled or indirectly coupled. It should be noted that the elements and/or assemblies of the system may be constructed from any of a wide variety of materials that provide sufficient strength or durability, in any of a wide variety of colors, textures and combinations. In addition, as stated throughout, wheelchair accommodating system 10 is not limited to applications relating to a lectern. In alternative embodiments, system 10 may be used in any application wherein it would be beneficial to bring the surface of a structure to a user. Examples may include applications in a retail environment wherein a cash register is coupled to an adjustable first platform which provides a wheelchair user with access to the register. Further examples may include coupling a drinking fountain, a washbasin or sink, a kitchen countertop, etc. to an adjustable first platform which provides a wheelchair user with access. Accordingly, all such modifications are intended to be included within the scope of the present inventions. Other substitutions, modifications, changes and omissions may be made in the design, operating conditions and arrangement of the preferred and other exemplary embodiments without departing from the spirit of the present inventions.

The order or sequence of any process or method steps may be varied or re-sequenced according to alternative embodiments. In the claims, any means-plus-function clause is intended to cover the structures described herein as performing the recited function and not only structural equivalents but also equivalent structures. Other substitutions, modifications, changes and omissions may be made in the design, operating configuration and arrangement of the preferred and other exemplary embodiments without departing from the spirit of the inventions as expressed in the appended claims.

What is claimed is:

1. A wheelchair accommodating system for providing an ergonomically suitable environment for users having a motor skill limitation and users without a motor skill limitation, the system comprising:

a support structure providing a media equipment storage space supporting at least one shelf, the media equipment storage space being defined by a front wall, a top wall, a rear wall and a pair of spaced apart side walls aligned substantially perpendicular to the front wall and the rear wall, the rear wall defining an opening allowing access to the media equipment storage space, the top wall having at least one of an inclined surface and a curvilinear surface near the rear wall that provides clearance for a first platform;

a first platform coupled to the support structure and having a height, angle of rotation, and depth;

a height adjustment system coupled between the support structure and the first platform for adjusting the height of the first platform;

a first tilt adjustment system coupled between the support structure and the height adjustment system for adjusting the angle of rotation of the first platform; and a depth adjustment system coupled between the height adjustment system and the first platform for adjusting the depth of the first platform relative to the height adjustment system, wherein a wheelchair user and a non-wheelchair user may selectively actuate the height adjustment system, the first tilt adjustment system, and the depth adjustment system to bring the first platform to the user to provide a work surface that is ergonomically suitable for the user.

2. A wheelchair accommodating system for providing an ergonomically suitable environment for users having a motor skill limitation and users without a motor skill limitation, the system comprising:

a support structure providing a media equipment storage space supporting at least one shelf, the media equipment storage space being defined by a front wall, a rear wall and a pair of spaced apart side walls aligned substantially perpendicular to the front wall and the rear wall, the rear wall defining an opening allowing access to the media equipment storage space;

a first platform coupled to the support structure and having a height, angle of rotation, and depth;

a height adjustment system coupled between the support structure and the first platform for adjusting the height of the first platform;

a first tilt adjustment system coupled between the support structure and the height adjustment system for adjusting the angle of rotation of the first platform;

a depth adjustment system coupled between the height adjustment system and the first platform for adjusting the depth of the first platform relative to the height adjustment system; and an expandable support structure configured to stabilize the system when the depth of the first platform is adjusted, wherein a wheelchair user and a non-wheelchair user may selectively actuate the height adjustment system, the tilt adjustment system, and the depth adjustment system to bring the first platform to the user to provide a work surface that is ergonomically suitable for the user.

3. The system of claim 2, wherein the wheelchair accommodating system is a lectern.

4. The system of claim 3, wherein the wheelchair accommodating system is a multi-media lectern.

5. The system of claim 2, wherein the system is configured to be used by non-wheelchair users ranging in height from approximately 4 feet to 7 feet.

6. The system of claims 2, wherein the system is configured to be used by wheelchair users having wheelchairs with seat portions that range in height from 15 inches to 20 inches.

7. The system of claim 2, wherein the height adjustment system adjusts the height of the first platform between approximately 20 inches and 60 inches.

8. The system of claim 7, wherein the height adjustment system includes a drive mechanism coupled to the support structure and the first platform.

9. The system of claim 8, wherein the drive mechanism is a telescopic drive mechanism.

10. The system of claim 8, wherein the drive mechanism is an electric drive mechanism that can be selectively actuated by a user.

11. The system of claim 2, wherein the tilt adjustment system adjusts the angle of rotation of the first platform between approximately 0 degrees and 30 degrees.

12. The system of claim 11, wherein the tilt adjustment system adjusts the angle of rotation of the first platform up to approximately 20 degrees.

13. The system of claim 12, wherein the tilt adjustment system includes a drive mechanism coupled to the support structure and the first platform.

14. The system of claim 13, wherein the drive mechanism is an electric drive mechanism that can be selectively actuated by a user.

15. The system of claim 13, wherein at least two drive mechanisms are used to adjust the angle of rotation of the first platform.

16. The system of claim 2, wherein the depth adjustment system adjusts the depth of the first platform approximately 20 inches.

17. The system of claim 16, wherein the depth adjustment system includes a drive mechanism coupled to the support structure and the first platform.

18. The system of claim 17, wherein the drive mechanism is an electric drive mechanism that can be selectively actuated by a user.

19. The system of claim 2, wherein the support structure includes a door movably coupled to the rear wall and configured to selectively cover the opening.

20. The system of claim 2, wherein the expansion of the expandable support structure is coupled to the movement of the first platform so that the expandable support structure expands as the depth of the first platform is moved toward the user.

21. The system of claim 20, further comprising a roller coupled to the support structure and the expandable support structure.

22. The system of claim 2, further comprising a second tilt adjustment system, the second tilt adjustment system being coupled between the height adjustment system and the first platform for further adjusting the angle of rotation of the first platform.

23. The system of claim 22, wherein height adjustment system, the first tilt adjustment system, the second tilt adjustment system and the depth adjustment system are capable of being actuated independent of each other by the user.

24. A lectern suitable for use by a wheelchair user and a non-wheelchair user, the lectern comprising:

a work surface;

a support structure;

a first actuator having a first end coupled to the support structure and a second end coupled to the work surface, the first actuator being selectively actuatable by the user to adjust a height of the work surface relative to the support structure;

a second actuator having a first end coupled the support structure and a second end coupled to the first actuator, the second actuator being selectively actuatable by the user to adjust an angle of rotation of first actuator relative to the support structure;

a third actuator having a first end coupled to the first actuator and a second end coupled to the work surface, the third actuator being selectively actuatable by the user to adjust an angle of rotation of the work surface relative to the first actuator; and a fourth actuator having a first end coupled to the first actuator and a second end coupled to the work surface, the fourth actuator being selectively actuatable by the user to adjust a depth of the work surface relative to the first actuator.

25. The lectern of claim 24, wherein the first actuator, the second actuator, the third actuator and the fourth actuator can be actuated independent of each other.

26. The lectern of claim 24, wherein the lectern is a multi-media lectern and the base includes a media equipment storage space having at least one shelf, the media equipment storage space being defined by a front wall, a rear wall and a pair of spaced apart side walls, the rear wall defining an opening allowing access to the storage space.

27. The lectern of claim 26, wherein the media equipment storage space is further defined by a top wall having an inclined surface near the rear wall that provides clearance for the work surface when one of the second actuator and third actuator is actuated.

28. The lectern of claim 26, wherein the support structure includes a door movably coupled to the rear wall and configured to selectively cover the opening.

29. The lectern of claim 24, further comprising at least one sensor located at a bottom portion of the work surface near an edge close to the user, wherein the at least one sensor provides an output signal to stop movement of the work surface.

30. The lectern of claim 24, wherein the support structure further comprises a lower extension portion that is selectively movable to an extended position to provide additional stability to the lectern.

31. The lectern of claim 30, wherein movement of the lower extension portion is coupled to the movement of the work surface so that the lower extension portion moves toward the extended position as the depth of the work surface is moved toward the user.

32. The lectern of claim 24, wherein the first actuator, the second actuator, the third actuator and the fourth actuator each comprise an electric drive mechanism having an interface that can be selectively actuated by the user.

33. The lectern of claim 24, wherein the first actuator comprises a telescopic drive mechanism.

34. The lectern of claim 24, wherein the first actuator comprises a first telescopic drive mechanism near a first side wall of the support structure and a second telescopic drive mechanism near a second side wall of the support structure.

35. A lectern system that is suitable for use by a wheelchair user and a non-wheelchair user, the lectern system comprising:

a support structure providing a media equipment storage space supporting at least one shelf, the media equipment storage space being defined by a front wall, a rear wall and a pair of spaced apart side walls aligned substantially perpendicular to the front wall and the rear wall, the rear wall defining an opening allowing access to the storage space;

a work surface coupled to the support structure and having a height, angle of rotation, and depth that are independently adjustable relative to the support structure;

an adjustment mechanism coupled between the support structure and the work surface for adjusting the height, angle of rotation and depth of the work surface, the adjustment mechanism comprising a first actuator for adjusting the height of the work surface, a second actuator for adjusting the angle of rotation of the work surface, and a third actuator for adjusting the depth of the work surface, the first actuator having a first end coupled to the support structure and a second end coupled to the work surface, the second actuator having a first end coupled to the support structure and a second end coupled to the first actuator, and the third actuator having a first end coupled to the first actuator and a second end coupled to the work surface; and a safety system intended to prevent a wheelchair user from being harmed by the work surface as the work surface is being brought to the user, the safety system comprising a pressure sensitive sensor located at likely pinch points between the work surface and a wheelchair user, wherein a user may selectively adjust at least one of the height, angle of rotation and depth of the work surface to bring the work surface to the user to provide a work surface that is ergonomically suitable for the user.

36. The lectern system of claim 35, wherein the lectern system is a multi-media lectern.

37. The lectern system of claim 36, wherein the at least one shelf comprises at least one rack rail for supporting an electronic article.

38. The lectern system of claim 35, wherein the support structure includes a door movably coupled to the rear wall and configured to selectively cover the opening.

39. The lectern system of claim 35, wherein a pressure sensitive sensor is positioned along a bottom edge of the work surface at an end near a user.

* * * * *